United States Patent [19]

Stollberg et al.

[11] 4,184,625

[45] Jan. 22, 1980

[54] CONTAINER FOR FRESH PRODUCTS SUCH AS ASPARAGUS

[75] Inventors: Ray H. Stollberg, Gilroy; Wendell J. Johnson, Manteca; Richard O. Welch, Modesto, all of Calif.

[73] Assignee: Crown Zellerbach Corporation, San Francisco, Calif.

[21] Appl. No.: 974,201

[22] Filed: Dec. 28, 1978

[51] Int. Cl.[2] ..... B65D 77/26; B65D 85/30

[52] U.S. Cl. ..... 229/23 BT; 206/526; 206/594; 229/52 B; 220/DIG. 6

[58] Field of Search ..... 206/526, 594, 521, 44 R, 206/491; 229/34 HW, 23 BT, 37 R, 52 B; 220/DIG. 6

[56] References Cited

U.S. PATENT DOCUMENTS

| | | | |
|---|---|---|---|
| 2,044,035 | 6/1936 | Weiss | 206/44 R |
| 3,892,346 | 7/1975 | Hughes et al. | 220/DIG. 6 |
| 4,105,152 | 8/1978 | Elward | 229/23 BT |

*Primary Examiner*—William T. Dixson, Jr.
*Attorney, Agent, or Firm*—Thomas R. Lampe

[57] ABSTRACT

A container for fresh products such as asparagus comprising the combination of an open box body having interconnecting front, bottom, back and end walls, the walls having a substantially rectangular configuration, an insert positionable in the box body and defining therewith an interior of trapezoidal-shaped cross-section for accomodating the fresh products, and a cover for placement over the box body and the insert.

6 Claims, 6 Drawing Figures

CONTAINER FOR FRESH PRODUCTS SUCH AS ASPARAGUS

BACKGROUND OF THE INVENTION

The packing and shipping of fresh cut asparagus have historically presented peculiar problems and have resulted in the design of specialized containers for the product. Traditionally, asparagus has been shipped in trapezoidal-shaped wooden boxes, packed vertically to allow the asparagus to continue to grow in the box. Immediately after packing the box, the asparagus is hydro-cooled with ice water to retard growth as much as possible. Wooden boxes have increased greatly in price and the asparagus industry is increasingly turning to paperboard box structures. Problems that have been encountered with respect to paperboard boxes, however, include product packing difficulty and the use of large quantities of material per box to maintain adequate strength, especially stacking strength. Also, at least some of the paperboard boxes such as that disclosed in U.S. Pat. No. 3,863,829 are fully constructed from a single blank and require that the box go through the hydro-cooler with the cover in position in order to maintain adequate box strength.

It is therefore an object of the present invention to provide a container for asparagus and the like characterized by its ease of loading.

It is a further object of the present invention to provide a container for asparagus and the like characterized by its high strength.

It is yet another object of the present invention to provide a container for asparagus and the like that is readily adapted for display after shipping.

It is yet another object of the present invention to provide a container for asparagus and the like that maintains adequate strength in the hydro-cooling process without the cover component being positioned over the box body thus improving the efficiency of the hydro-cooling process.

SUMMARY OF THE INVENTION

According to the present invention, a container for fresh products such as asparagus is provided which is of simple and economical construction and yet has the characteristics desired in a container used to pack and ship such product. In particular, the container comprises three elements:

1. an open top box body having interconnected front, bottom, back and end walls, the walls having a substantially rectangular configuration,
2. an insert positionable in the box body and defining therewith an interior of trapezoidal-shaped cross-section for accomodating the fresh products, and
3. a cover for placement over the box body and the insert after hydro-cooling.

The insert comprises a die-cut pad having a main panel and triangular-shaped side panels attached thereto, said insert panel adapted to extend between the box body end walls when the insert is positioned within the box body with the insert side panels being in face-to-face engagement with the box body end walls.

Other objects and characteristics of the invention will be apparent from the following more detailed description and accompanying drawings in which:

DETAILED DESCRIPTION

Figure 1:
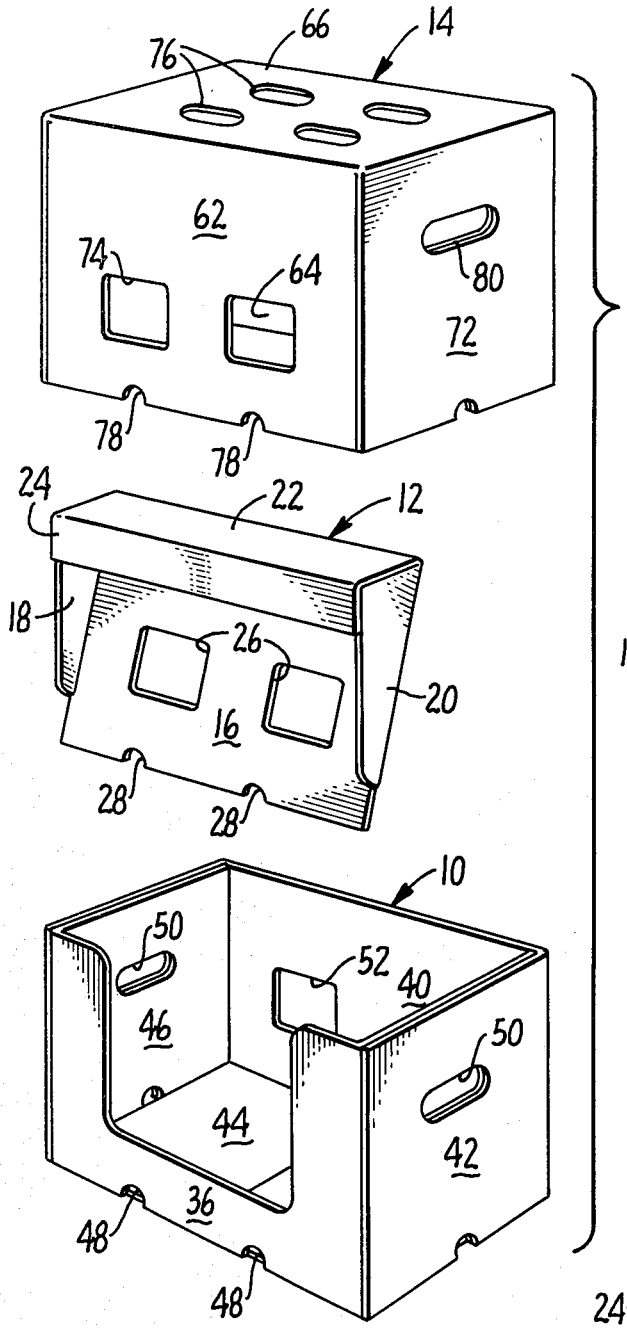
FIG. 1 is an exploded isometric view of the container showing the three container components prior to assembly thereof.

Referring now to FIG. 1., the container of the present invention comprises three separate elements, namely an open top box body 10, an insert 12 positionable in the box body and a cover 14 for placement over the box body and insert.

Figure 6:
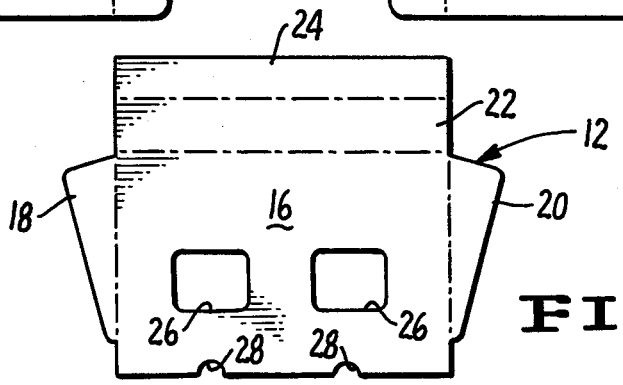
FIG. 6 is a plan view of the blank for the insert element of the container.

With reference to FIGS. 1 and 6, the insert 12 is a die cut pad preferably formed of double-faced corrugated paperboard material and including a main panel 16, triangular-shaped side panels 18 and 20 connected to the main panel along hinge lines, a hingedly connected top panel 22 and a lip panel 24 sharing a common hinge line with top panel 22. Apertures 26 are formed in the insert main panel as are semicircular cuts 28 disposed at the bottom of the main panel.

Figure 5:
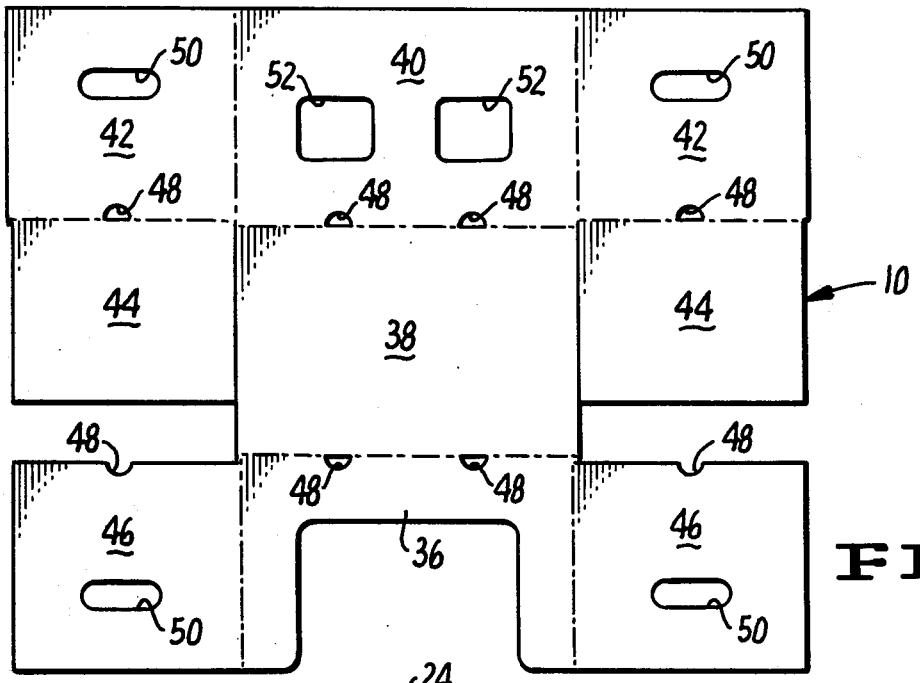
FIG. 5 is a plan view of the blank for the box body component of the container.

With reference to FIGS. 1 and 5, box body 10 comprises a front wall 36 of general U-shaped configuration, a bottom wall panel 38 hingedly connected to front wall 36 and a back wall 40 hingedly connected to bottom wall panel 38. Connected to the ends of back wall 40 are end wall panels 42. Connected to end wall panels 42 are bottom wall panels 44. End wall panels 46 are hingedly connected to the ends of front wall 36 as shown. Semicircular cuts 48 are formed in the box body blank in the positions illustrated. Hand holes 50 are formed in end wall panels 42 and 46. Apertures 52 are preferably formed in back wall 40.

The box body is assembled as follows. Back wall 40 is positioned perpendicular to bottom wall panel 38 about the hinge line. End wall panels 42 and bottom wall panels 44 are then manipulated so that the bottom wall panel 44 overlap bottom wall panel 38 and end wall panels 42 are disposed at right angles to both back wall 40 and bottom wall panel 38. Front wall 36 is then positioned perpendicular to the bottom wall panels and brought into face-to-face engagement with the inner surfaces of end wall panels 42 to form the end walls. The full assembly is then secured together by any desired expedient such as staples. As was the case with respect to insert 12, the box body is preferably formed of double-faced corrugated paperboard material, and in particular corrugated material that has been heavily wax-impregnated and coated to provide moisture strength during the hydro-cooling process.

Figure 4:
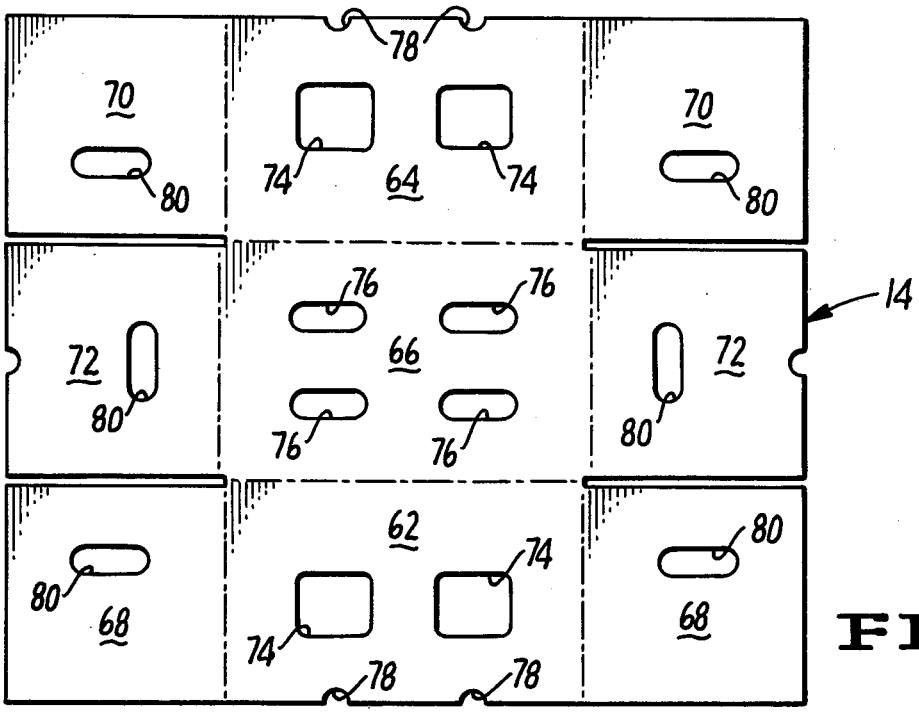
FIG. 4 is a plan view illustrating the blank for the cover component of the container.

Referring now to FIGS. 1 and 4, the preferred cover 14 includes front and back cover panels 62, 64, respectively, connected to a centrally disposed top cover panel 66. Panels 62, 64, and 66, have secured to the respective ends thereof along hinge lines cover panels 68, 70, and 72. To assemble the cover, front and back cover panels 62 and 64 are positioned perpendicular to top cover panel 66 and end cover panels 68 and 70 are brought into face-to-face relationship. End cover panels 72 are then disposed at right angles to top cover panel 66 so that they overlie the previously positioned panels 68 and 70. Staples or other means are used to maintain the cover in assembled condition. Apertures 74 are preferably formed in the front and back cover panels as are apertures 76 in top cover panel 66. Hand holes 80 corresponding in size to hand holes 50 in box body 10 are formed in the end cover panels. It will be appreciated that hand holes 80 are in alignment when the cover is assembled as previously described. The cover is preferably formed of double-faced corrugated material; however, it is not necessary that the corrugated material be wax impregnated since the cover is not meant to be run through the hydro-cooling equipment and thus need not have unusual wet strength. Semicircular cuts 78 are made in the cover blank as shown.

Figure 2:
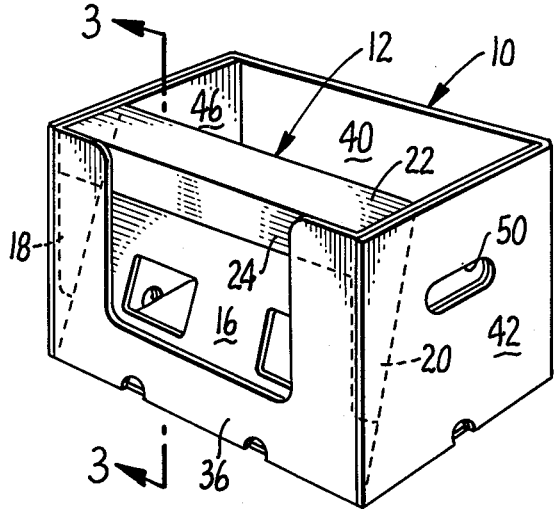
FIG. 2 is an isometric view of the box body and insert positioned therein.
Figure 3:
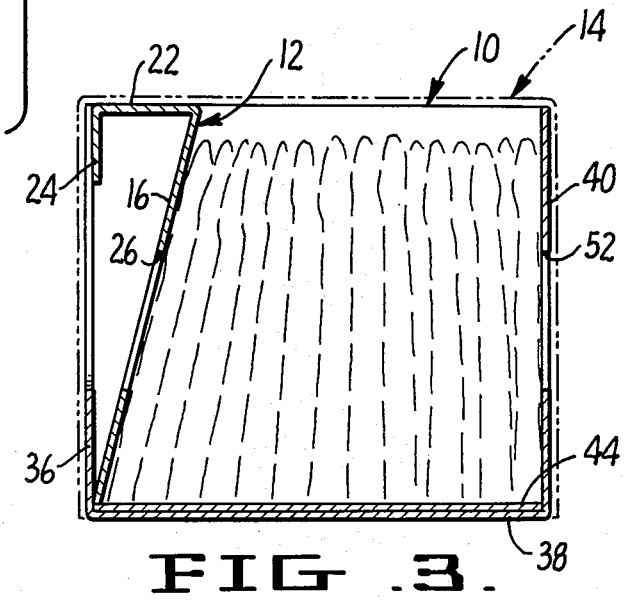
FIG. 3 is a sectional view taken along line 3—3 of FIG. 2 and illustrating asparagus in the trapezoidal-shaped interior defined by the box body and insert.

After the box body 10 has been assembled and appears in the condition shown in FIG. 1, it is ready for loading of the asparagus or other similar produce to be packed therein. An important feature of the present invention resides in the fact that the outside of the container is of conventional rectangular form while the box body and insert 12 cooperate to define an interior of trapezoidal-shaped cross section for accomodating the asparagus spears or the like. As may be seen with reference to FIG. 3 asparagus spears A are to be positioned within box body 10 standing on their lower ends. It will be appreciated that asparagus spears are tapered so the spears take up less space near the top of the box body than at the bottom thereof. Hence, the need for insert 12 to prevent the cut spears from moving about during transport. A preferred packing approach is to load spears A into the empty box body until the bottom of the box body is essentially completely occupied by the spears. The packer then may place the insert 12 into position as shown in FIG. 3. Alternatively, the packer may place insert 12 within the box body prior to packing the spears as shown in FIG. 2. It will be appreciated, however, that this approach is not quite as efficient as first packing the spears and then putting the insert into place.

When the insert is positioned in the box body the insert main panel 16 extends between the box body end walls and side panels 18 and 20 are in face-to-face engagement with the box body end walls. The triangular configuration of the side panels 18 and 20 serves to maintain main panel 16 at the desired angle. It should also be noted that top panel 22 extends from main panel 16 to front wall 36 of the box body. Lip panel 24 bears against the box body front wall 36 in face-to-face relationship therewith.

After the asparagus has been packed and insert 12 is positioned within box body 10 the container with the exception of the cover is sent to the hydro-cooler. Hydro-cooling is a conventional practice in the asparagus packing art. Asparagus has a tendency to grow even after it is cut and the hydro-cooling effect of flooding the asparagus with ice water will retard such growth. After the hydro-cooling has taken place the cover 14 is positioned over the box body, insert and asparagus as shown in phantom in FIG. 3. When the cover is in position semicircular shaped cuts 28, 48, and 78 of the container elements are in alignment thus providing communication between the interior of the container and the outside. This will enable hydro-cooling water to drain from the container even after the cover has been placed in position. It should also be noted that the hand holes 50 and 80 are in registry when the cover is placed over the box body.

From the foregoing it will be readily apparent that the container of the present invention has considerable stacking strength because on the outside thereof it is of conventional rectangular configuration on all sides. The insert, however, makes the container particularly applicable for shipping and storing tapered products such as asparagus. After shipping, the product may be readily displayed in the box body by removing the cover and insert, the generally U-shaped configuration of front wall 36 providing a view of essentially the full length of the spears.

We claim:

1. A container for fresh products such as asparagus comprising the combination of:

an open top box body having interconnecting front, bottom, back and end walls, said bottom, back and end walls all having a substantially rectangular configuration, and said front wall having a generally U-shaped configuration to define a display aperture therein;

a separate removable insert positionable in said box body, and defining therewith an interior of trapezoidal-shaped cross section for accommodating said fresh products, said insert being a die cut pad having a main panel and generally triangular-shaped side panels connected to said insert main panel at the ends thereof, said insert main panel adapted to extend between the box body end walls and between the fresh products therein and the display aperture when said insert is positioned within said box body with said insert panels being in face-to-face engagement with said body end walls, said insert additionally comprising an insert top panel connected to the top of said insert main panel and angularly disposed relative thereto when said insert is positioned in said box body to define a horizontally disposed ledge extending between the insert main panel and said box body front wall and a lip panel depending from said insert top panel adapted to be disposed in face-to-face relationship with the box body front wall, when said insert is positioned in said box body, and a separate removable cover for placement over said box body and said insert.

2. The container according to claim 1 wherein said box body bottom wall is of double thickness being comprised of overlapping bottom wall panels.

3. The container according to claim 2 wherein one of said box body bottom wall panels is hingedly attached to and extends between said box body front and back walls and another bottom wall panel is integrally attached to at least one box body end wall.

4. The container according to claim 1 wherein said box body, insert and cover define aligned drain apertures at the bottom of said container.

5. The container according to claim 1 wherein said box body end walls are of double thickness being comprised of overlapping end wall panels.

6. The container according to claim 1 wherein hand holes are formed in said box body end walls and in said cover, said hand holes being in communication when said cover is positioned over said box body.

* * * * *